United States Patent [19]

Franklin

[11] Patent Number: 4,506,389

[45] Date of Patent: Mar. 26, 1985

[54] TIE CONSTRUCTION

[75] Inventor: Stanley Franklin, Northridge, Calif.

[73] Assignee: Briar Neckwear, Inc., Los Angeles, Calif.

[21] Appl. No.: 425,037

[22] Filed: Sep. 27, 1982

[51] Int. Cl.[3] ..... A41D 25/16

[52] U.S. Cl. ..... 2/144; 2/146

[58] Field of Search ..... 2/144, 146, 150, 157, 2/153; 12/121.22

[56] References Cited

U.S. PATENT DOCUMENTS

| | | | |
|---|---|---|---|
| 1,593,299 | 7/1926 | Goldberg | 2/146 |
| 1,803,388 | 5/1931 | Hall | 2/146 |
| 1,916,507 | 7/1933 | Green et al. | 2/146 X |
| 2,082,447 | 6/1937 | Gold | 2/146 |
| 3,378,854 | 4/1968 | Limperos | 2/146 |

*Primary Examiner*—Werner H. Schroeder
*Assistant Examiner*—J. L. Kravitz
*Attorney, Agent, or Firm*—Martin A. Farber

[57] ABSTRACT

A novel tie construction of enhanced stability of shape and smoothness comprises a support layer extending along the entire inside of the tie substantially complementary to the periphery of the front fabric material of the tie, the layers being folded together therewith.

6 Claims, 3 Drawing Figures

TIE CONSTRUCTION

BACKGROUND OF THE INVENTION

The present invention relates to an improved necktie construction.

Conventionally, a facing fabric material is sewed to the interior of a tie at the V-shaped end portions forming a pocket, primarily for aesthetic reasons when looking at the interior at the back of the tie and for insertion of the end of a relatively narrow, thicker lining to give shape, substance and body to the tie.

Yet this tie construction does not result in a perfect tie. The tie often still puckers, ripples, wrinkles and twists and does not maintain its shape. It is not sufficiently firm and resilient, and its life is limited. The "seven fold" (layer) construction used in very fine neckwear in the 1st half of this century provides a good quality tie but its cost is prohibitive, as it requires using at least twice as much fine (expensive) tie fabric as a conventional necktie.

Some have tried without success to remedy this situation, yet the fineness of the product requires a solution that could not be found. Some have tried to increase the thickness of the lining, but this produced a bulky, coarse tie.

SUMMARY OF THE INVENTION

Accordingly it is an object of the present invention to provide an improved tie construction avoiding the above disadvantages offering a fine quality necktie and yet being made with a minimum expense both with respect to production and material.

The object of the present invention is achieved by providing a support layer of fine mesh material on the interior of the tie which extends the full length and width of the tie complementary to, up to and along the periphery of the front tie material and which participates in all the folds of the tie.

Advantageous effects of this tie in accordance with the present invention arise as a result of this support layer which is folded together with and hence along all the same folds as the front tie material as it is folded into its final form. No additional working steps occur, except to cut and position this support layer. The shape of this layer corresponds to the size and shape of the front tie material, providing excellent body and stability to the tie. There is a one-to-one correspondence between the effects on the front tie material and the effects on the support layer. It eliminates puckering, rippling, twisting and creates a perfectly beautiful drape, providing the same result as with the conventional "seven fold" construction.

With the above and other objects and advantages in view, the present invention will become more clearly understood in connection with the detailed description of a preferred embodiment, when considered with the accompanying drawings, of which:

DESCRIPTION OF THE PREFERRED EMBODIMENTS

Figure 1:
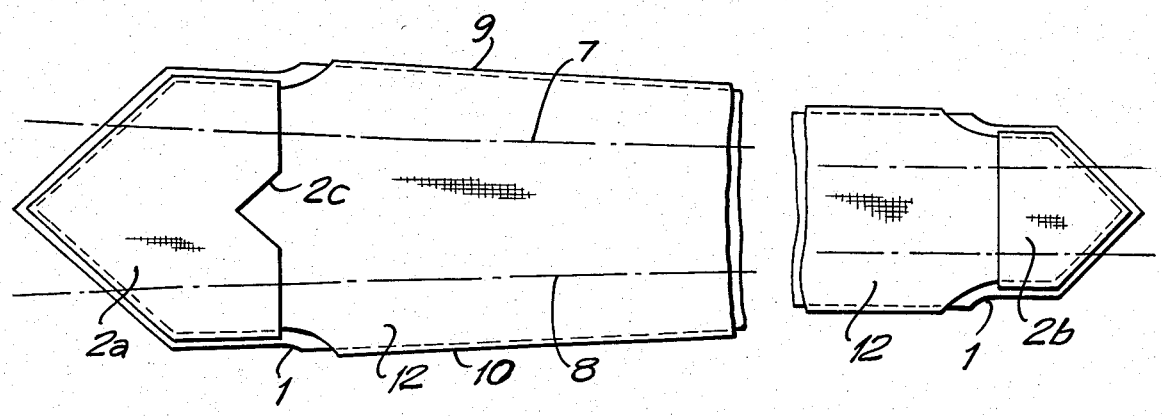
FIG. 1 is a plan view of the tie in the process of manufacture after cutting and laying the tie material and support layer but before folding and partially broken away.

Referring to the drawings, a piece of fine fabric tie material 1 is cut from a large roll of tie material having desired patterns and colors. This material 1 is then further cut into predetermined tie patterns in one or more sections suitable to the formation of a tie. The tie material is then laid flat. After first cutting small substantially V-shaped tipping pieces *2a, 2b* having a shape corresponding to the V shape of the ends of the tie, the tipping pieces *2a, 2b* are positioned at the V ends on the interior side of the tie. Rough edges of the tie material 1 and the pieces *2a, 2b* at both of the V ends are flanged inwardly into a clean finished hem with interior (not visible) stitching at the V-shaped periphery at the interior side of the V ends of the tie. The separate pockets (also denoted with the reference *2a, 2b*) thus formed on the interior side at the ends have substantially the same shape as the ends of the fabric tie material 1, namely in this example, although not limited thereto, a V-shape. In addition, a symmetrical V-shape notch *2c* was cut in the center of the free transverse edge of the tipping piece *2a*.

A support layer 12, made of a firm layer of fine mesh, high quality material, such as satin or the like, although not limited thereto since many other materials are suitable, is cut on a cutting machine preferably into two sections although one piece is also possible, and with the cut between the two sections inclined (not shown in the figures). The support layer 12 is cut so as to have substantially the same length, shape and size as the tie material 1 (i.e., it is substantially complementary thereto).

This support layer 12 is laid flat on the interior side of the flat laid open tie material 1 and the ends of the support layer 12 are inserted into the pockets *2a, 2b* as illustrated in FIG. 1. This complementarily shaped, full length support layer 12 is inserted at its ends into the pockets *2a, 2b* with the entire peripheries both of the support layer 12 and of the tie material 1 including the V-shaped ends positioned substantially complementarily on one another. SCOTCH (trademark) tape is placed overlapping the pockets *2a, 2b* and the support layer 12 on both remote ends as well as on any other intermediate cut sections of the support layer 12 to hold the support layer 12 in place.

Figure 2:
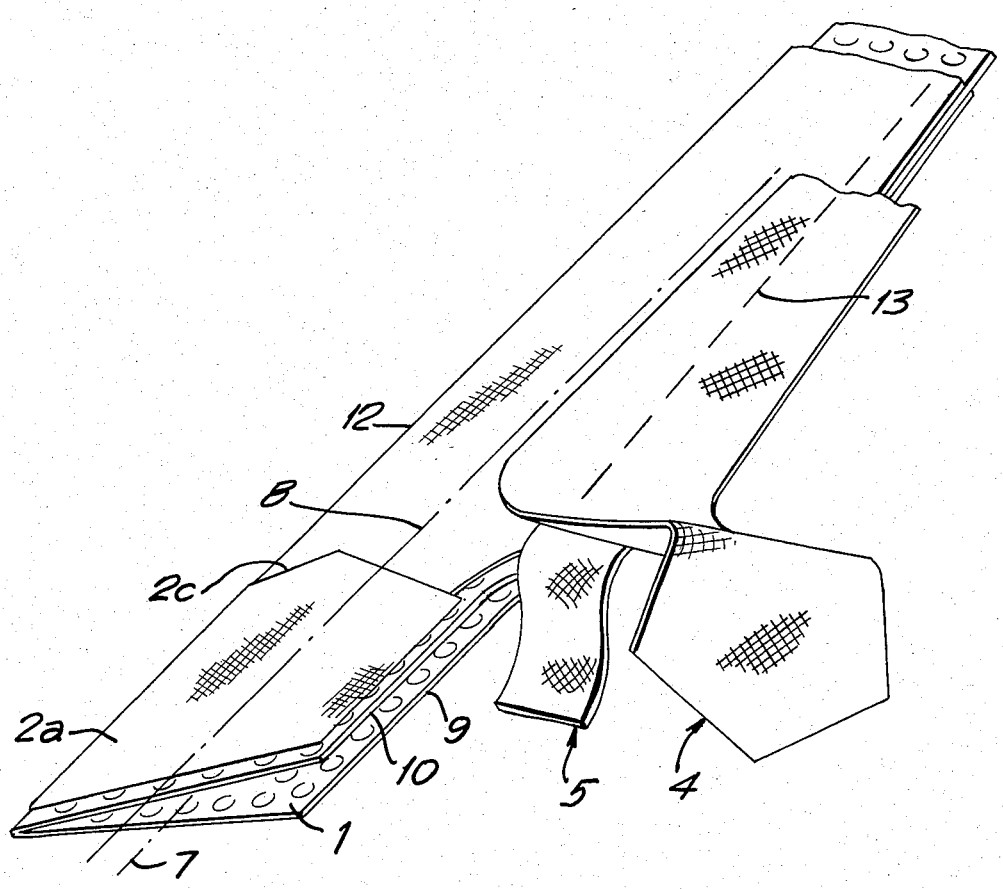
FIG. 2 is a broken away perspective view of the tie of FIG. 1 in a later stage of production.

Next the peripheral longitudinal edges 9 and 10 are aligned by folding the tie throughout its length inside out as shown in FIG. 2. Then a coarse regular wool lining 4 and a tape 5 FIG. 2 (which is substantially rectangular and generally smaller than the regular lining 4), prepared in similar fashion to the other two materials 1 and 12 but with a smaller width, are laid offset on the layer 12 with their center along the peripheral longitudinal edges 9 and 10 of the tie.

The tie is slip-stitched by threading (shown as the numeral 13) through the center of the regular lining 4, the tape 5, the aligned longitudinal peripheral edges 9 and 10 of the tie material, and the support layer 12 with a long thread over the length of the tie, catching all the aligned longitudinal peripheral edges of the tie and the center of the regular lining 4 plus the tape 5. The all SCOTCH (trademark) tape is then removed.

A conventional tool is then inserted through the long loop so formed engaging the remote end of the tie which is then pulled through and turned inside-in outside-out, the ends of the lining 4 being inserted into the pockets *2a, 2b,* so that the final tie is produced. The lining 4 has the shape and size of the final tie and serves a template-like function during this operation. It is made of a coarse thicker material compared to the support layer 12. The tie is then pressed. The tie produced is a seven fold tie (two layers on the front and two folded double layers on the back and one lining layer therebetween).

Figure 3:
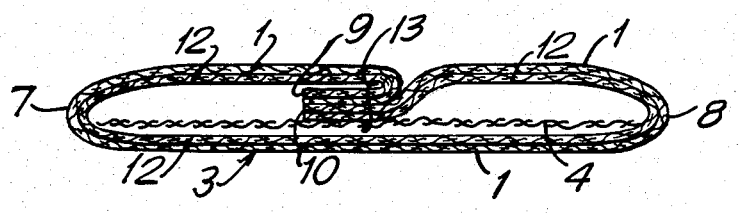
FIG. 3 is a view in cross section of the finished tie, but before pressing and in exagerated proportions merely for general illustration.

By this operation and by pressing the final tie thus has been folded along the longitudinal fold lines 7, 8 adjacent the longitudinal edges of the lining 4 as shown in FIG. 3, for example, but not limited thereto, the support layer 12 folding everywhere exactly as does the tie material 1. No threading connection of the peripheries of the support layer 12 and the tie material 1 was effected prior to the single slip-stitching 13 which is employed simultaneously to fasten the lining 4 and all the other mentioned elements.

An excellent tie is produced having the advantages previously described which is extremely firm even when the tie material 1 is a fine silk print.

While I have disclosed one embodiment of the invention, it is to be understood that this embodiment is given by example only and not in a limiting sense.

I claim:

1. A tie construction, comprising a front tie material of elongated shape having end portions including tips, tipping pieces having a periphery complementary to each end portion of said front tie material, said tipping pieces being peripherally flanged and peripherally stitched to an inwardly flanged periphery of the end portions of said front tie material so as to form pockets in cooperation with said end portions of said front tie material, a support layer having a periphery extending substantially along the entire periphery of the front tie material from tip to tip longitudinally as well as laterally, having substantially the same size and shape as the front tie material, being substantially complementarily positioned on the inside of said front tie material, and end portions of said support layer freely extend into said pockets, respectively, with the periphery of said support layer in said pockets being free and unsecured, a lining having a periphery smaller than that of the front tie material and substantially the same as that of the tie to be produced and formed substantially parallel to the periphery of said front tie material and positioned against said support layer in the tie, and end portions of said lining freely extending into said pockets, respectively, with the periphery of said lining in said pockets being free and unsecured, means for connecting said lining to both said front tie material and to said support layer along abutting opposite longitudinally extending peripheral edge portions of said front tie material and said support layer exclusively at the inside of the tie, said connection means extending between and excluding said pockets.

2. The tie construction as set forth in claim 1, wherein said means constitutes a single slip-stitching.

3. A tie construction, comprising a front tie material of elongated shape, a support layer having a periphery extending substantially along the entire periphery of the front tie material from end to end longitudinally as well as laterally, having substantially the same size and shape as the front tie material, being complementarily positioned on the inside of said front tie material, a pocket layer connected to the periphery of the tie material at an end of the tie forming a separate tipping pocket, an end of said support layer freely extends in said pocket with the periphery of said support layer being unsecured in said pocket, a lining having a periphery formed smaller but substantially parallel to the periphery of the tie material and substantially the same as that of the tie to be produced and positioned on the inside of said support layer in the tie, an end of the lining extending freely into said pocket with the periphery of said support layer being unsecured in said pocket, a single slip-stitching connects said lining to the front tie material and to the support layer along abutting opposite longitudinally extending peripheral edge portions of the front tie material and the support layer at an intermediate longitudinal portion of said lining between the ends of the lining substantially up to but outside of said pocket.

4. The tie construction as set forth in claim 3, further comprising a tape formed smaller than the lining and positioned centrally on the inside of said lining.

5. The tie construction as set forth in claim 4, wherein said single stitch is exclusively at the inside of the tie, whereby it is visible on the surface of the tie.

6. The tie construction as set forth in claim 4, wherein said stitch is also simultaneously connected to an intermediate longitudinal portion of said tape.

* * * * *